US006097789A

United States Patent [19]

Mueller

[11] Patent Number: 6,097,789

[45] Date of Patent: Aug. 1, 2000

[54] X-RAY TUBE WITH HIGH-VOLTAGE PLUG

[75] Inventor: Werner Mueller, Wilhermsdorf, Germany

[73] Assignee: Siemens Aktiengesellschaft, Munich, Germany

[21] Appl. No.: 09/118,969

[22] Filed: Jul. 20, 1998

[30] Foreign Application Priority Data

Jul. 21, 1997 [DE] Germany ..... 197 31 233

[51] Int. Cl.[7] ..... H01J 35/10

[52] U.S. Cl. ..... 378/130; 378/141

[58] Field of Search ..... 378/141, 130, 378/144, 199, 200

[56] References Cited

U.S. PATENT DOCUMENTS 2,098,315 11/1937 Sharp .
2,790,102 4/1957 Atlee .
4,584,699 4/1986 LaFiandra et al. .
5,596,621 1/1997 Schwarz et al. .

FOREIGN PATENT DOCUMENTS

PS 71 80 31 2/1942 Germany .
G 9844 10/1955 Germany .

*Primary Examiner*—David P. Porta
*Assistant Examiner*—Pamela R. Hobden
*Attorney, Agent, or Firm*—Hill & Simpson

[57] ABSTRACT

An x-ray tube has a rotating anode and a high-voltage plug for attachment at a high-voltage terminal at a vacuum housing of the x-ray tube. The high-voltage plug contains a cooling channel for coolant which opens up into a channel provided in the shaft of the rotating anode. The cooling channel extends through the high-voltage plug substantially in the direction of the center axis (axis of rotation) of the rotating anode.

7 Claims, 2 Drawing Sheets

X-RAY TUBE WITH HIGH-VOLTAGE PLUG

BACKGROUND OF THE INVENTION

1. Field of the Invention

The present invention relates to an x-ray tube of the type having a rotating anode and a high-voltage plug for attachment to a high-voltage terminal at the vacuum housing of the x-ray tube the plug containing a cooling channel for a coolant which opens into another channel provided in a shaft or axle serving for rotationally supporting the rotating anode.

2. Description of the Prior Art

German PS 44 32 205, corresponding to U.S. Pat. No. 5,596,621, describes an x-ray tube of this type, for example. The danger of voltage arcing between the part of the high-voltage plug which conducts the voltage and the vacuum housing of the x-ray tube lying at a varying potential is decreased in such an x-ray tube, since it has been demonstrated that an improved voltage stability results from the cooling of the high-voltage plug. Moreover, cooling of the rotatable bearing of the rotating anode (e.g. ball bearing) is also achieved. Nevertheless, despite the cooling impermissibly increased temperatures arise in the region of the bearing under certain operating conditions.

German OS 34 37 870 describes an x-ray tube with a hollow shaft or hollow axle serving for the bearing of the rotating anode.

SUMMARY OF THE INVENTION

It is an object of the invention to provide an x-ray tube of the abovementioned type wherein besides an improved voltage stability, further reduction of the temperatures present in the region of the bearing are made possible.

This object is inventively achieved in an x-ray tube with a rotating anode and a high-voltage plug for attachment at a high-voltage terminal the vacuum housing of the x-ray tube, the plug containing a cooling channel for a coolant, wherein the channel extends through the high-voltage plug substantially in the direction of the center axis (axis of rotation) of the rotating anode and opens into another channel provided in a shaft or axle serving for bearing the rotating anode.

As a result of the fact that the cooling channel extends through the high-voltage plug substantially in the direction of the center axis of the rotating anode, a significant reduction of the current losses is enabled compared to known devices, so that the preconditions are created to guarantee a sufficient cooling of the rotatable bearing of the rotating anode, even given problematic operating conditions.

In a preferred embodiment of the invention, the high-voltage plug has a contact part cooperating with a corresponding part of the x-ray tube and connected to a high-voltage cable in an electrically conducive fashion, the cooling channel extending through this contact part. In this embodiment structural space which is necessary anyway is used to accommodate the cooling channel, so that for further improved cooling of the bearing of the rotating anode, a further reduction of the voltage losses can be achieved by large-scale dimensioning of the cooling channel.

In another embodiment of the invention a connector of electrically insulating material opens into the contact part, the cooling channel extending through this connector and a line for the coolant being connected to this connector, then despite the fact that the cooling channel extends through the contact part of the high-voltage plug, it is possible to provide for the necessary electrical insulation of the line for the coolant from the contact piece in a technically simple and economic manner.

In another preferred embodiment of the invention the channel in the anode shaft extends along the whole length through the shaft and at the end of the shaft distal to the high-voltage plug, the channel opens into a line for the coolant. In this way it is possible to have the coolant flow through the channel in a particularly low-loss fashion.

In another variation of the invention the channel in the shaft or axle of the rotating anode is sealed at the end distal to the high-voltage plug, and an inner line is accepted in the channel. The possibility then exists to have the coolant flow to the sealed end of the channel in the region of the channel exterior to the inner line and from there back to the high-voltage plug through the inner line. The flow direction can also be reversed. If it is necessary to be able to have the coolant flow in a circulation loop, the inner line can extend through the connector in a liquid-tight manner.

The inner line is preferably accepted in the channel coaxially.

Liquid or gaseous media are suitable as a coolant. Insulating oil is particularly suitable as it is normally present in the protective housing accepting the x-ray tube. It is also possible to use the same insulating oil which is present in the protective housing as the coolant which flows through the cooling channel.

DESCRIPTION OF THE PREFERRED EMBODIMENTS

Figure 1:
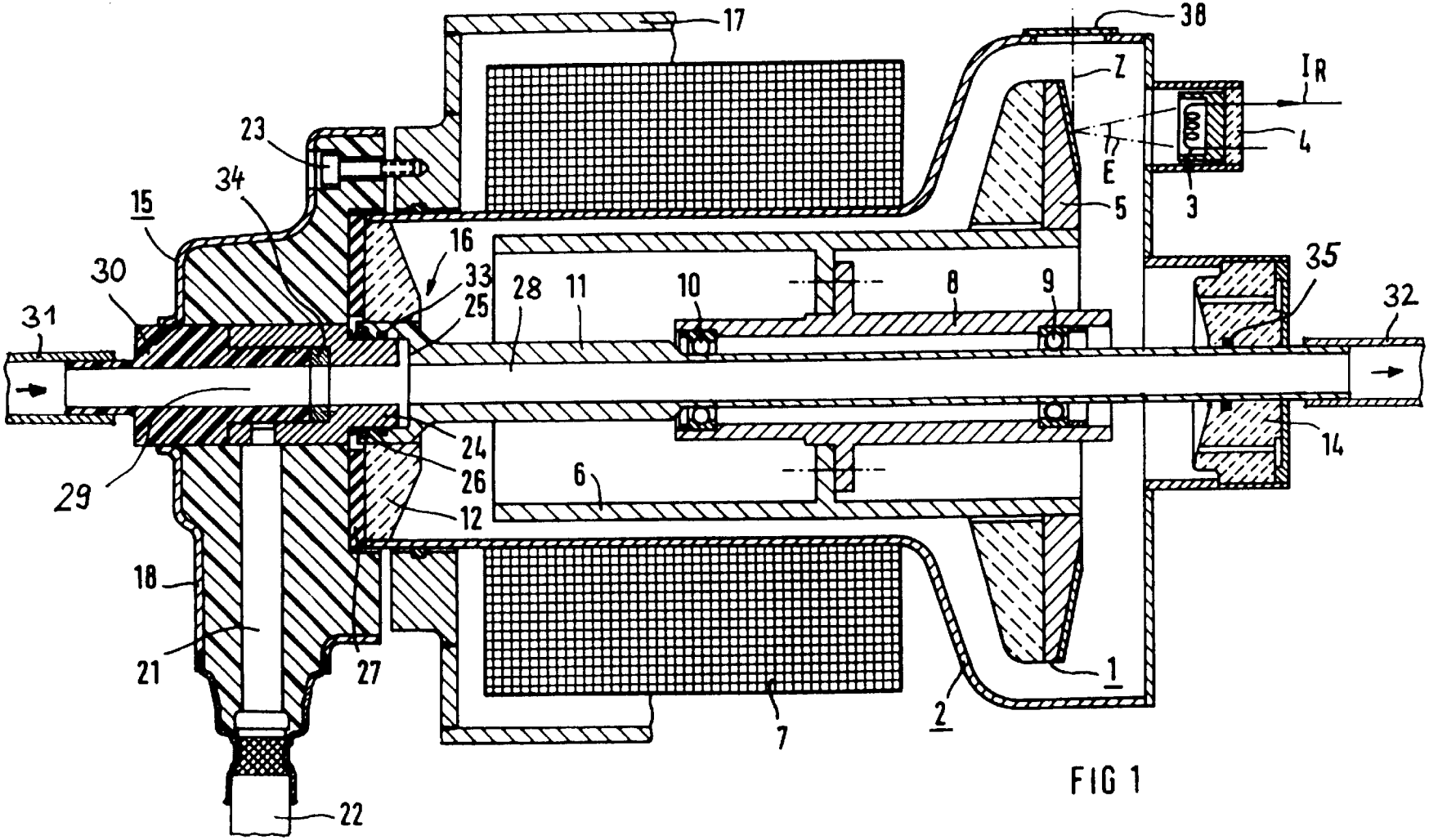
FIG. 1 is a schematic illustration, partly in section, of a first embodiment of an x-ray tube according to the invention.

FIG. 1 depicts an x-ray tube which has a rotating anode arrangement—designated 1 overall—which is accommodated in a vacuum housing 2. The vacuum housing 2 additionally contains a cathode arrangement in known fashion, in whose concentrating cup 4 a helical filament 3 is accepted.

The rotating anode arrangement 1 includes an anode dish 5 which is connected to the one end of a tubular component serving as a rotor 6 of an electromotor provided for driving the rotating anode arrangement 1. The stator 7 of the electromotor is placed outside onto the vacuum housing 2 in the region of the rotor 6.

A bearing sleeve 8 is connected to the rotor 6 via a flange joint—the screws are indicated with dot-and-dash lines only. In the bore of the bearing sleeve 8, outer rings of rolling bearings 9 and 10 are accepted which serve to support the rotating anode arrangement 1 on a stationary bearing axle 11 in a rotatable fashion.

The bearing axle 11 is connected at one end to an annular ceramic component 12 of the vacuum housing 2. At its other end, the bearing axle 11 is accepted in a corresponding opening of an annular ceramic component 14 which is accepted in a corresponding cylindrically shaped shoulder of the vacuum housing 2.

In the case of the x-ray tube according to FIG. 1, feeding of the tube current occurs via a high-voltage plug connection; i.e., by means of a high-voltage plug 15 which is attached at a region of the vacuum housing 2 constructed as a high-voltage terminal 16. The region of the vacuum housing 2 constructed as a high-voltage terminal 16 lies outside a protective housing 17—shown only partially in FIG. 1—in which the x-ray tube is contained to form an x-ray radiator, as taught in German OS 42 09 377.

When the x-ray tube is supplied with tube current, the tube current is tapped via one of the terminals of the helical filament 3, and a heating voltage is applied between the two terminals of the helical filament 3. The stator 7 is supplied with operating voltage to rotate the anode dish 5, and an electron beam E emanates from the helical filament 3, striking the rotating anode dish 5 in a focal spot, and an x-ray beam bundle then emanates from the focal spot, exiting from the vacuum housing 2 through the radiation exit window 38. The center beam of the x-ray beam bundle is designated z in FIG. 1.

The high-voltage plug 15 has a part 19 composed of insulating material which is surrounded by a sheet metal casing 18, a contact part 20 being embedded in this part 19. The contact part 20 is electrically conductively connected to a feeder 21, by means of a peg-shaped shoulder of the feeder 21 inserted into a transverse hole of the contact part 20. A high-voltage cable 22 is attached at the free end of the feeder 21 by means of a crimp connection.

As contact surface the contact part 20 constructed in a rotationally symmetrical fashion forms the outer cladding surface of a cylindrical shoulder 24 engaged in a correspondingly formed recess 25 of the bearing axle 11. The cladding surface of the shoulder 24 cooperates with the sidewall of the recess 25 in the manner of a plug connection.

In order to enable the conducting of the anode current under all conditions, a contact spring 26 is arranged between a step of the contact part 20 and the fore-part of the bearing axle 11. Between the annular part of the ceramic component 12 and a corresponding surface of the part 19 of insulating material, an elastically non-positive wafer 27 of insulating material is arranged which can consist of silicon rubber, for example. The wafer 27 of insulating material should prevent voltage arcing between the contact part 20, the contact spring 26 and the bearing axle 11, as well as between the part of the vacuum housing 2 extending outwardly through the protective housing 17 and accepting the ceramic component 12 .

The high-voltage plug 15 is secured at the protective housing 17 by means of a few screws, only one of which is visible in FIG. 1 and is designated 23. It is understood that the x-ray tube is securely fixed within the protective housing 17 in a known fashion.

The bearing axle 11 is constructed as a hollow axle and has a central channel 28 extending through the whole length of the bearing axle 11. The channel 28 is traversed by a coolant in the operation of the x-ray tube for cooling the rolling bearings 9 and 10.

The coolant, for example a cooling oil or the insulating oil present in the protective housing 17, reaches the channel 28 through a cooling channel 29 which extends through the high-voltage plug 15 proceeding substantially in the direction of the axis of rotation, or center axis, of the rotating anode arrangement—the cooling channel 29 in fact runs centrally through the contact part 20. The cooling channel 29 additionally extends through a connector 30 formed of an electrically insulating material. The connector 30 opens at one end into the section of the cooling channel 29 in the contact part 20, and has an opposite end which projects through the sheet metal casing 18 of the high-voltage plug 15 in the exterior. A line 31 for the coolant is connected at this end of the connector 30. The line 31 is in connection with the cooling channel 29 and the channel 28.

In the region of the end of the bearing axle 11 which is farther from (distal to) the high-voltage plug 15 and is accepted in the component 14, the channel 28 opens into a line 32 for the coolant.

The possibility thus exists—as indicated by arrows in FIG. 1—to have the coolant flow into the cooling channel 29 and the channel 28 through the line 31 and out of the channel 28 again through the line 31. The coolant can flow in a circulation loop (not depicted) a coolant circulator (such as a pump) as well as a heat sink if necessary.

To guarantee the necessary liquid seal, conical nipples 33 and 34 are provided between the contact part 20 and the recess 25 of the bearing axle 11 as well as between the contact part 20 and the connector 30. A seal 35 is additionally provided between the component 14 and the end of the bearing axle 11 accepted therein, this seal 35 being not only liquid-tight, but also vacuum-tight.

As a consequence of the inventive structure of the x-ray tube, the coolant can flow through the cooling channel 29 and the channel 28 without the occurrence of directional changes or notable changes in cross-section. Only minor losses of current arise thereby, so that for a defined throughput of coolant only a comparatively low conveying capacity is expended.

Figure 2:
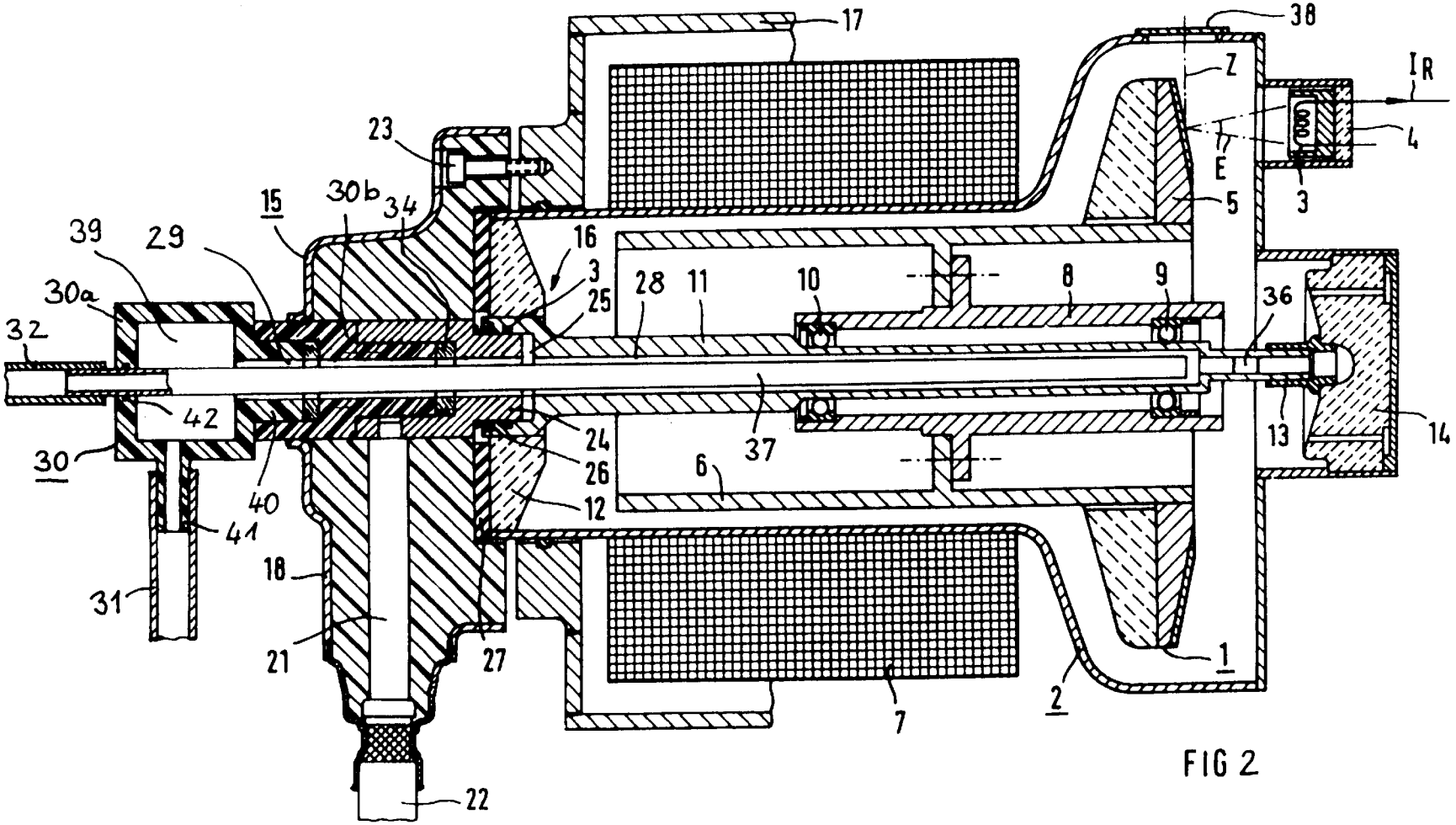
FIG. 2 is a schematic illustration, partly in section, of a second embodiment of an x-ray tube according to the invention.

In the exemplary embodiment depicted in FIG. 2 (the same or similar components have the same reference characters as in FIG. 1) the channel 28 is occluded by a stopper 36 at the end distal to the high-voltage plug 15.

The coolant channel 29 opening into the channel 28 extends again through the contact part 20 and the connector 30 which is composed of two parts 30a and 30b in the case of the embodiment according to FIG. 2.

The part 30*a* is of tubular shape and is inserted in the contact part 20. The part 30*b* surrounds a hollow space 39 which opens into the part 30*a* via a connection piece 40, and is fitted with a terminal 41 for the line 31.

Coolant can thus reach the stopper 36 from the line 31 via the terminal 41, the hollow space 39, the section of the cooling channel 29 defined by the parts 30*a* and 30*b* of the connector 30, and the part of the cooling channel 29 defined by the contact part 20, and through the channel 28 provided in the bearing axle 11 .

To enable flow of the coolant, an inner line 37 is inserted coaxially into the cooling channel 29 and the channel 28, the line 37 penetrating the sidewall of the part 30*b* of the connector 30 (this sidewall borders the hollow space 38 and is disposed at a distance from the high-voltage plug 15) and terminating shortly before the stopper 36. A conical nipple 42 is provided between the inner line 37 and the part 30*b*. The line 32 is attached at the inner line 37.

As previously mentioned, the coolant can enter through the line 31 and exit again through the line 32. The reverse flow direction is also possible.

As in the case of the embodiment of FIG. 1, the coolant can flow in a circulation loop having coolant circulator and also a heat sink if necessary.

In both of the described exemplary embodiments, a rotating bearing sleeve and a stationary bearing axle are provided for bearing the rotating anode. It is understood that a stationary bearing sleeve and a rotating bearing shaft can be provided instead. Likewise, instead of the rolling bearing provided for bearing of the rotating anode in the case of the exemplary embodiments, a plain bearing can be provided in known fashion.

Furthermore, the high-voltage plug connection need not necessarily lie outside the protective housing as in the case of the described exemplary embodiments. The invention can also be used with the high-voltage plug connection located within the protective housing.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray tube comprising:

a vacuum housing;

an anode and a cathode disposed in said vacuum housing;

means for rotating said anode in said vacuum housing, including a shaft connected to said anode and having an axis of rotation, said shaft having a channel extending in said shaft only along said axis of rotation;

a high-voltage terminal accessible at an exterior of said vacuum housing for supplying voltage for operating said x-ray tube; and a high-voltage plug, mating with said high-voltage terminal, said high-voltage plug having a channel extending therethrough and communicating with said channel in said shaft, said channel in said high-voltage plug proceeding only along said axis of rotation; and means for introducing a coolant through said channel in said high-voltage plug and said channel in said shaft, said coolant flowing in the respective channels in said high-voltage plug and in said shaft unidirectionally along said axis of rotation.

2. An x-ray tube as claimed in claim 1 wherein said high-voltage plug comprises a contact part and wherein said high-voltage terminal has a corresponding contact part cooperating with said contact part of said high-voltage plug to form an electrically conductive path, said cooling channel in said high-voltage plug extending through said contact part in said high-voltage plug.

3. An x-ray tube as claimed in claim 2 wherein said contact part has a connector comprises of electrically insulating material through which said cooling channel in said high-voltage plug extends, and attachable to a coolant line of said means for introducing coolant.

4. An x-ray tube as claimed in claim 1 wherein said channel in said shaft extends along an entire length of said shaft, and wherein said shaft has an end distal from said high-voltage plug communicating with a coolant line of said means for introducing coolant.

5. An x-ray tube as claimed in claim 1 wherein said shaft has an end distal from said high-voltage plug, said end being occluded to flow of coolant, and further comprising an inner coolant line disposed inside said channel in said shaft.

6. An x-ray tube as claimed in claim 5 wherein said high-voltage plug comprises a contact part and wherein said high-voltage terminal has a corresponding contact part cooperating with said contact part of said high-voltage plug to form an electrically conductive path, said cooling channel in said high-voltage plug extending through said contact part in said high-voltage plug, said contact part of said high-voltage plug having a connector comprised of electrically insulating material, said cooling channel in said high-voltage plug extending through said connector, and said connector communicating with a coolant line of said means for introducing coolant, and wherein said inner line extends through said connector in a liquid-tight manner.

7. An x-ray tube as claimed in claim 5 wherein said inner line is disposed coaxially in said channel in said shaft.

* * * * *